US007695131B2

(12) United States Patent
Yun et al.

(10) Patent No.: US 7,695,131 B2
(45) Date of Patent: Apr. 13, 2010

(54) MEDIA DETECTION APPARATUS AND METHOD USABLE WITH IMAGE FORMING APPARATUS

(75) Inventors: Young-Jung Yun, Suwon-si (KR); Jin-Ho Park, Yongin-si (KR); Ho-Bin Hwang, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1217 days.

(21) Appl. No.: 11/248,127

(22) Filed: Oct. 13, 2005

(65) Prior Publication Data

US 2006/0083129 A1 Apr. 20, 2006

(30) Foreign Application Priority Data

Oct. 16, 2004 (KR) ..... 10-2004-0082937
Dec. 16, 2004 (KR) ..... 10-2004-0107437

(51) Int. Cl.
*B41J 2/01* (2006.01)
*B41J 29/393* (2006.01)
*B41J 29/38* (2006.01)

(52) U.S. Cl. ..... 347/105; 347/19; 347/14

(58) Field of Classification Search ..... 347/101, 347/14, 19, 105; 399/16; 356/71; 250/559.4, 250/559.41

See application file for complete search history.

(56) References Cited

U.S. PATENT DOCUMENTS 6,386,669 B1 * 5/2002 Scofield et al. ..... 347/14
6,386,676 B1 * 5/2002 Yang et al. ..... 347/19
6,586,759 B1 * 7/2003 Mayo et al. ..... 250/559.4
6,794,669 B2 * 9/2004 Chelvayohan et al. ... 250/559.4
6,914,684 B1 * 7/2005 Bolash et al. ..... 356/600
7,205,561 B2 * 4/2007 Chelvayohan et al. ... 250/559.4

FOREIGN PATENT DOCUMENTS

| | | | |
|---|---|---|---|
| JP | 10-198174 | | 7/1998 |
| JP | 11-282223 | | 10/1999 |
| JP | 2002-182518 | | 6/2002 |
| JP | 2002-202705 | | 7/2002 |
| JP | 2003-302885 | | 10/2003 |
| KR | 1999-49938 | | 7/1999 |
| KR | 10-0281594 | * | 2/2001 |
| KR | 2002-46945 | | 6/2002 |

* cited by examiner

*Primary Examiner*—Manish S Shah
*Assistant Examiner*—Rene Garcia, Jr.
(74) *Attorney, Agent, or Firm*—Stanzione & Kim, LLP

(57) ABSTRACT

A media detection apparatus and method usable with an image forming apparatus includes a light source to irradiate light to surfaces of recording media, a light receiving part to receive light reflected from the recording media an angle changing unit to change an angle of at least one of the light source and the light receiving part with respect to the recording media, and a controller to determine a type of recording media through signals measured from the light receiving part depending on the angle changed by the angle changing unit. The media detection apparatus is capable of effectively detecting the type of recording media by changing an irradiation angle and reflection angle of light.

39 Claims, 16 Drawing Sheets

MEDIA DETECTION APPARATUS AND METHOD USABLE WITH IMAGE FORMING APPARATUS

CROSS-REFERENCE TO RELATED APPLICATIONS

This application claims the benefit under 35 U.S.C. § 119 of Korean Patent Application Nos. 2004-82937, filed Oct. 16, 2004, and 2004-107437, filed Dec. 16, 2004, the disclosure of which is incorporated herein by reference in its entirety.

BACKGROUND OF THE INVENTION

1. Field of the Invention

The present general inventive concept relates to a media detection apparatus and method usable with an image forming apparatus, and more particularly, to a media detection apparatus and method usable with an image forming apparatus and capable of making print conditions optimal by determining what type of media is used in the image forming apparatus.

2. Description of the Related Art

An image forming apparatus is a device used to output electronic documents or graphic files stored in a host, such as a personal computer, on recording media, such as paper, and is generally classified into a static type image forming apparatus, such as a laser printer, and an inkjet type image forming apparatus, such as an inkjet printer.

The static type image forming apparatus employs a method of applying a developing agent such as toner on a surface of a photosensitive body, at which a static latent image is formed, and then transferring and setting the image on surfaces of the recording media to obtain printed matters. On the other hand, the inkjet type image forming apparatus employs a method of ejecting fine ink droplets to the surfaces of the recording media.

In order to implement high speed and high quality print, the image forming apparatus is capable of reducing a size of an expressible minimum dot and simultaneously printing a large number of dots. That is, precision of expression may be improved by enabling the image forming apparatus to print with smaller dots, and print speed may be increased by simultaneously printing the large number of dots.

Although the printable minimum dot size may be extremely decreased, it may be meaningless in certain recording media. For example, in the case of the inkjet type image forming apparatus, since ink droplets ejected in a small size may be spread and dried at different speeds depending on the type of recording media, the size of the ink droplets ejected from the ink ejection head may not effect the print quality on all types of recording media in the same way. In addition, when a large amount of ink is simultaneously ejected for high-speed printing, print quality may be deteriorated if the ink is not yet absorbed into the recording media. Similar problems may occur in the static type image forming apparatus.

Therefore, in order to perform high speed and high quality printing, it is necessary to vary print conditions depending on the type and characteristics of the recording media, and a device to detect what type of recording media is used to be installed in the image forming apparatus.

FIG. 1 is a schematic view illustrating a conventional media detection apparatus disclosed in U.S. Pat. No. 5,139,339. The conventional media detection apparatus 30 performs operations of irradiating light on a surface of a recording medium 35 moved therein using a light source 31, receiving light totally reflected and diffuse-reflected through two light receiving parts 32 and 33, respectively, and calculating a ratio therebetween, comparing the ratio with a predetermined ratio, and determining the type of the recording medium 35. In this process, the detection apparatus 30 irradiates the light on a plurality of portions of the recording medium 35 in order to improve its precision.

In general, the image forming apparatus uses recording media such as transparency paper, glossy photo paper, paper exclusively used for an inkjet printer, plain paper, and so forth. All of the different recording media have different characteristics, such as surface roughness, gloss, or the like. As a result, the different recording media have a difference between ratios of total reflection and diffuse reflection, thereby allowing the detection apparatus 30 to determine the type of recording media.

However, the detection apparatus 30 often incorrectly detects the type of recording media since surfaces of the recording media do not always maintain a planar state during conveyance of the recording media. That is, when the recording media is bent during conveyance thereof, since the surfaces of the recording media become irregular, the type of recording media may be incorrectly detected due to a difference between the predetermined and detected total reflection and diffuse reflection ratios. In addition, when a mounting angle of the detection apparatus is varied due to long-term use, the same problem may occur.

SUMMARY OF THE INVENTION

Accordingly, the present general inventive concept provides a media detection apparatus capable of reducing incorrect detection by providing uniform detection performance regardless of a state and a use period of recording media.

The present general inventive concept also provides a media detection method capable of reducing incorrect detection by providing uniform detection performance regardless of a state and a use period of recording media.

Additional aspects and advantages of the present general inventive concept will be set forth in part in the description which follows and, in part, will be obvious from the description, or may be learned by practice of the general inventive concept.

The foregoing and/or other aspects and advantages of the present general inventive concept are achieved by providing a media detection apparatus including a light source to irradiate light to surfaces of recording media, a light receiving part to receive light reflected from the recording media, and a controller to determine the type of recording media through signals measured by the light receiving part, while at least one of angles of the light source and the light receiving part with respect to the media is varied.

The angles of the light source and the light receiving part can be simultaneously varied by separate driving sources.

The angle of the light source or the light receiving part with respect to the recording media can be continuously varied by separate driving sources.

The detection apparatus may further include a frame to fix the light source or the light receiving part, a link installed at the frame to allow the frame to asymmetrically reciprocate the surfaces of the recording media, and a driving mechanism to drive the link.

The link may include a slot formed in the frame, a circular plate rotatable by the driving mechanism, and a projection formed at one side of the circular plate and inserted into the slot.

The detection apparatus may further include a frame to fix the light source or the light receiving part, an eccentric weight connected to the frame, and a driving mechanism to rotate the eccentric weight in order to vary the angle of the light source or the light receiving part with respect to the recording media.

The controller may detect the type of recording media by comparing a ratio between maximum and minimum values of the signals measured by the light receiving part with a predetermined value.

The controller may determine the recording media to be transparency power when the ratio between the maximum and minimum values is greater than a predetermined second reference value, and determine the recording media to be photo paper when the ratio is not greater than the second reference value and greater than a first reference value having a value lower than the second reference value.

When the ratio between the maximum and minimum values is not greater than the first reference value, the controller may calculate a dispersion value after measuring the signal at a plurality of portions of the recording media, determining the recording media to be plain paper when the calculated dispersion value is greater than a predetermined dispersion value, and determine the recording media to be inkjet paper when the dispersion value is not greater than the predetermined dispersion value.

The dispersion value may be measured at a plurality of portions along a lateral or longitudinal direction of the recording media.

The dispersion value may be calculated based on data obtained by the signals measured by the light receiving part.

The foregoing and/or other aspects and advantages of the present general inventive concept are also achieved by providing a media detection method of an image forming apparatus, the method including obtaining signals by reciprocating a media detection apparatus having a light source to irradiate light to surfaces of recording media and a light receiving part to receive light reflected from the recording media, within a predetermined range, calculating a ratio between the maximum and minimum values of the obtained signals, and determining the type of recording media by comparing the ratio with a predetermined value.

The determining the type of recording media by comparing the ratio with a predetermined value may include determining the recording media to be transparency paper when the ratio between the maximum and minimum values is greater than a predetermined second reference value, determining the recording media to be photo paper when the ratio is not greater than the second reference value and greater than a first reference value having a value less than the second reference value, and when the ratio between the maximum and minimum values is not greater than the first reference value, calculating a dispersion value after measuring the obtained signals at a plurality of portions of the recording media, determining the recording media to be plain paper when the dispersion value is greater than a predetermined dispersion value, and determining the media to be the inkjet paper when the dispersion value is not greater than the predetermined dispersion value.

The dispersion value of the recording media may be measured at a plurality of portions along a lateral or longitudinal direction of the recording media.

The dispersion value may be calculated based on data obtained by filtering the obtained signals.

The foregoing and/or other aspects and advantages of the present general inventive concept are also achieved by providing a media detection apparatus including a light source to irradiate light to surfaces of recording media, a light receiving part to receive light reflected from the recording media, an angle changing unit to change an angle of at least one of the light source and the light receiving part with respect to the recording media as the media is transferred, and a controller to determine a type of recording media through signals measured from the light receiving part depending on the angle changed by the angle changing unit.

The angle changing unit may include a body eccentrically installed on a conveying path of the recording media and installed in an inclined manner to allow the light source and the light receiving part to be directed toward the recording media, and a lever extending onto the conveying path of the recording media from the body to rotate the body in a conveying direction of the recording media by the recording media.

A mounting case to axially support the body therein may be installed at the conveying path of the recording media, and a flexible circuit board to apply a resilient force to the body in a direction opposite to the conveying direction of the recording media may be disposed at the mounting case.

The body may include a first guide passage to guide light irradiated from the light source and a second guide passage to guide light reflected from the recording media to the light receiving part.

The controller may compare a ratio of maximum and minimum values of the signals measured from the light receiving part with a predetermined value to determine the type of recording media.

The light receiving part may be made of one light receiving device.

The light source and the light receiving part may be fixed to be directed toward the same focus.

The light receiving part may alternately detect diffuse reflection and total reflection of the light reflected from the recording media using the angle changing unit.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
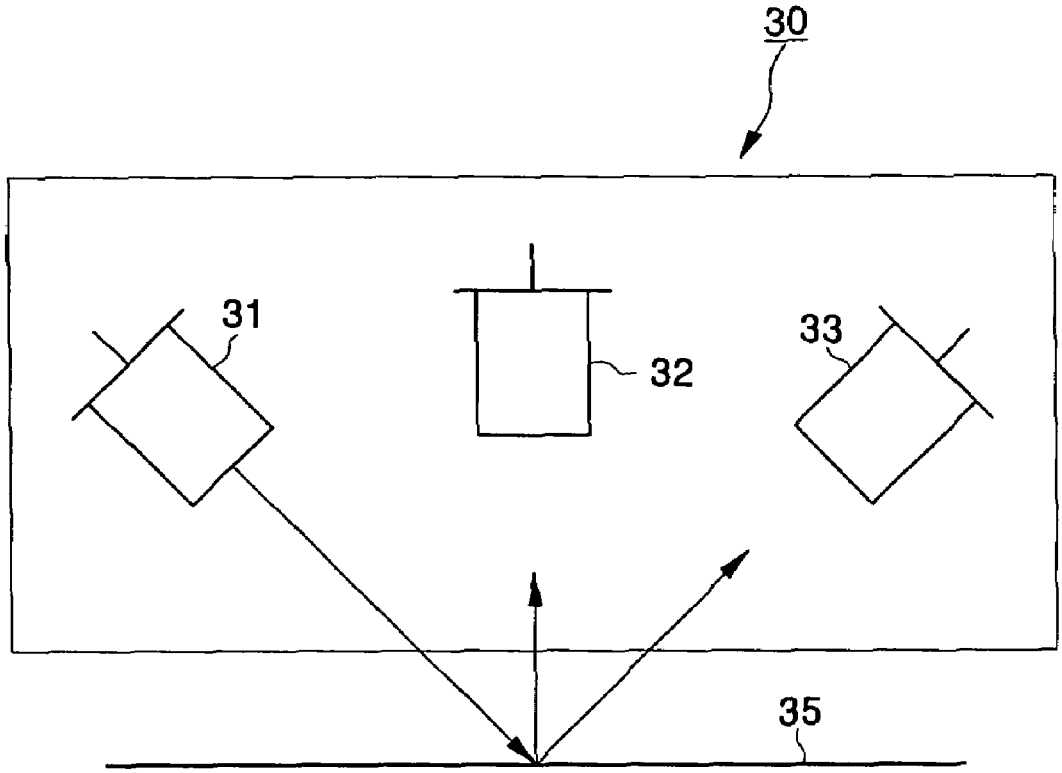
FIG. 1 (PRIOR ART)
FIG. 1 is a front view illustrating a conventional media detection apparatus.

Reference will now be made in detail to the embodiments of the present general inventive concept, examples of which are illustrated in the accompanying drawings, wherein like reference numerals refer to like elements throughout. The embodiments are described below in order to explain the present general inventive concept while referring to the figures.

Figure 2:
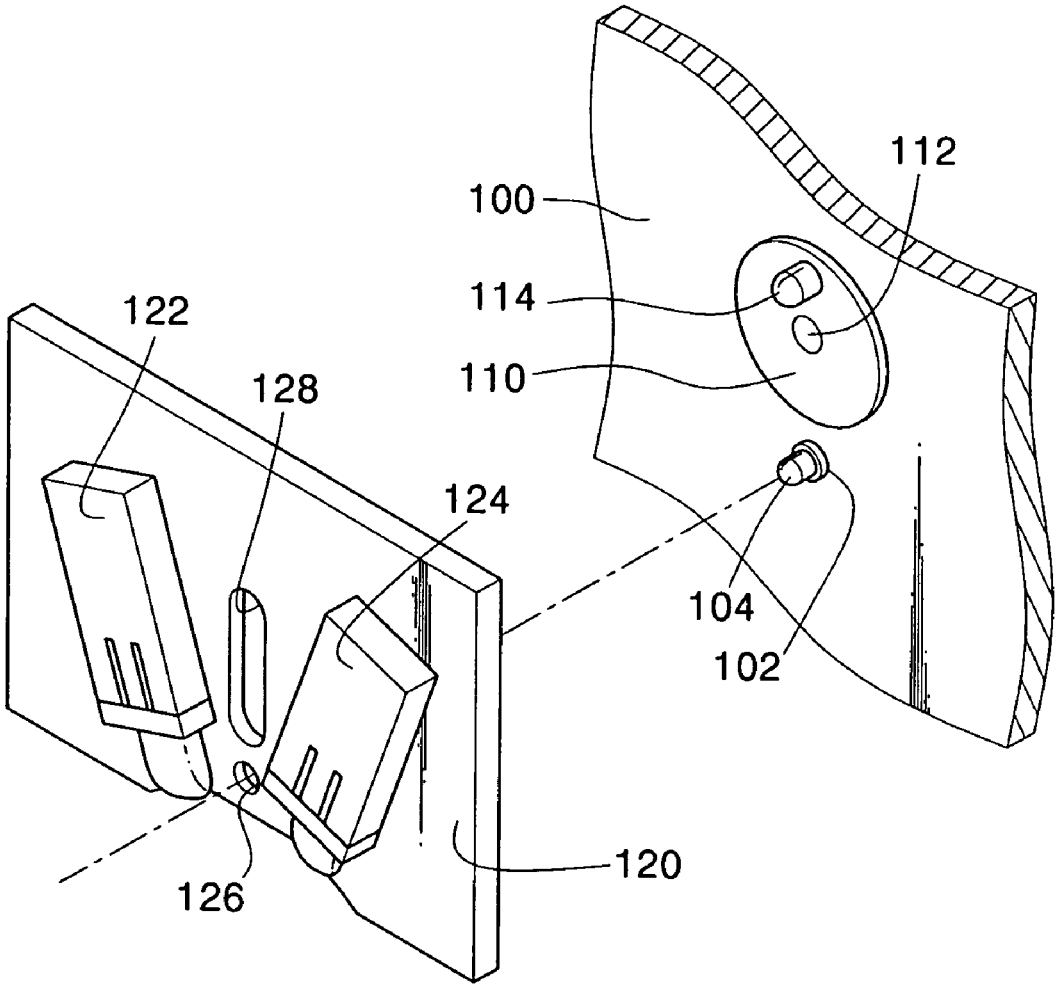
FIG. 2 is an exploded perspective view illustrating a media detection apparatus according to an embodiment of the present general inventive concept.

FIG. 2 illustrates a media detection apparatus according to an embodiment of the present general inventive concept. Referring to FIG. 2, the media detection apparatus connects to a portion of a main body 100 of an image forming apparatus. The media detection apparatus may be installed at arbitrary portions of the main body 100 capable of facing a surface of a recording medium, and is therefore not limited to any particular portion of the main body 100. For example, the portion of the main body 100 at which the media detection apparatus is connected may be an arbitrary structure located on a paper tray of the image forming apparatus, e.g., a carriage of an inkjet printer.

A circular shaped disk 110 is mounted on the main body 100. The disk 110 is fixed to a rotational shaft 112 of a driving unit, such as a motor (not shown), and rotatable about the rotational shaft 112 by rotation of the driving unit. A cylindrical connecting part 114 projects from a surface of the disk 110 adjacent to a periphery of the disk 110.

A projection 104 is formed under the disk 110, and a seating part 102 having a diameter larger than the projection 104 is formed at a lower portion of the projection 104.

A frame 120 is mounted on a surface of the main body 100 at the connecting part 114 and the projection 104. Mounted on a first surface (front) of the frame 120 is a light source 122 to irradiate light to surfaces of recording media, and a light receiving part 124 to receive light reflected from the surfaces of the recording media after being irradiated from the light source. The light source 122 and the light receiving part 124 are disposed in an asymmetrical manner with respect to an imaginary line extending perpendicularly from the surfaces of the recording media. In addition, a fixing hole 126 is formed at a lower portion of the frame 120 to accommodate the projection 104 therein. When the projection 104 is accommodated within the fixing hole 126, the seating part 102 is in contact with a rear surface of the frame 120. Further, a slot 128 extending in a longitudinal direction through the frame 120 is formed above the fixing hole 126, and the connecting part 114 is inserted into the slot 128.

The projection 104 is rotatably inserted into the fixing hole 126 and can be detachably fixed therein. The connecting part 114 reciprocates within the slot 128 along the longitudinal direction as the disk 110 rotates.

Figure 3A:
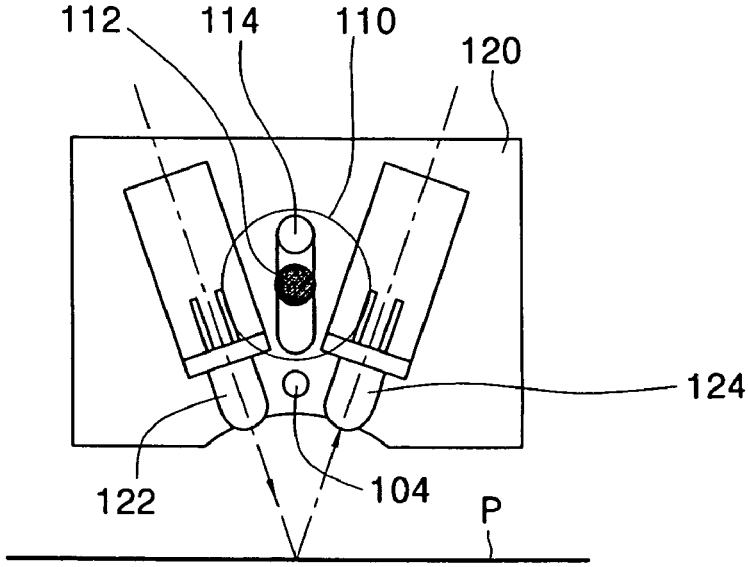
FIGS. 3A to 3D are front views illustrating an operation state of the media detection apparatus of FIG. 2.

FIG. 3A illustrates when the connecting part 114 is located at a 12 o'clock position of the disk 110. At this time, a bottom surface of the frame 120 is positioned parallel to a surface of a recording medium P, and an amount of the light irradiated from the light source 122 that is totally reflected from the surface of the recording medium P into the light receiving part 124 is at a maximum. Therefore, intensity of the light reflected to the light receiving part 124 is at a maximum value.

Figure 3B:
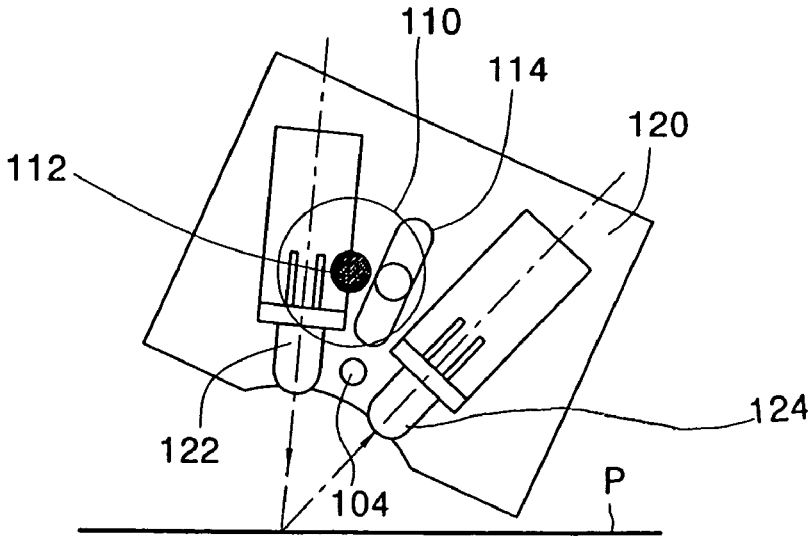

FIG. 3B illustrates when the disk 110 (and the connecting part 114) is rotated by 90° clockwise with respect to the position illustrated in FIG. 3A. As the disk 110 is rotated by 90° clockwise, the connecting part 114 is located at a 3 o'clock position of the disk 110 and moves within the slot 128 to rotate the frame 120 by a certain angle clockwise about the projection 104. When the frame 120 is rotated by the certain angle, the amount of the light irradiated from the light source 122 that is totally reflected from the surface of the recording medium P is at a minimum and diffuse reflected light from the total reflected light is introduced into the light receiving part 124. As a result, the intensity of the light reflected to the light receiving part 124 is at a minimum value.

Figure 3C:
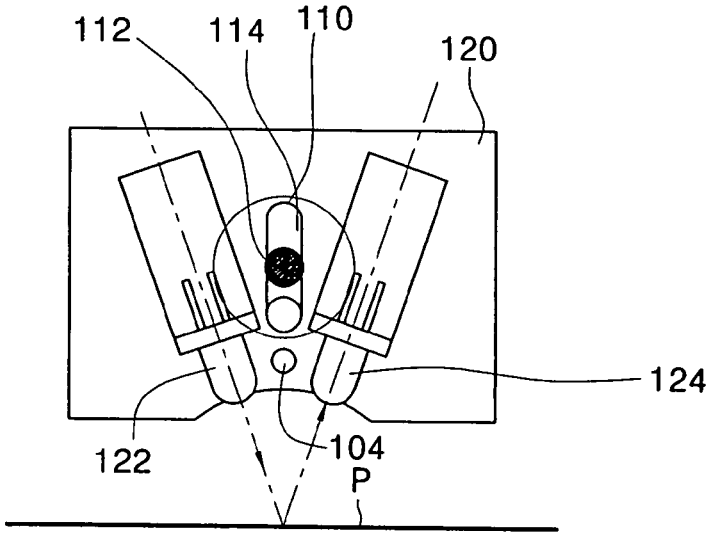
Figure 3D:
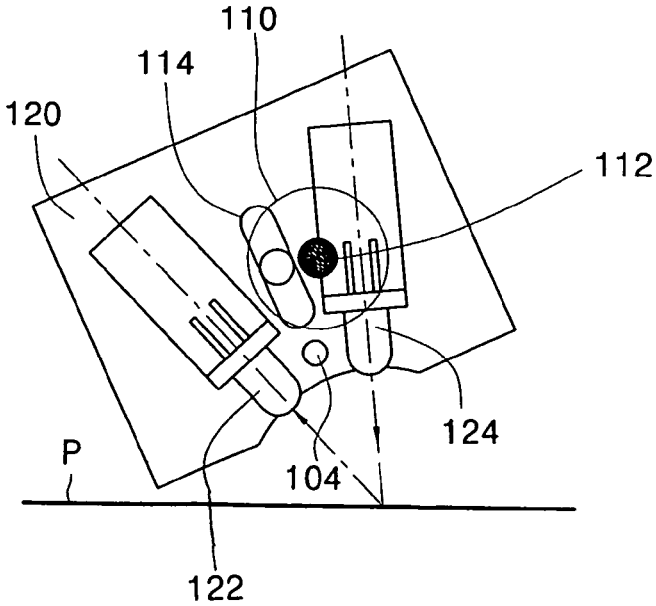

As the disk 110 is continuously rotated, the connecting part 114 returns to the position illustrated in FIG. 3A (the 12 o'clock position) through 6 o'clock and 9 o'clock positions, as illustrated in FIGS. 3C and 3C, respectively. When the connecting part 114 is at the 6 o'clock position, the frame 120 is positioned such that the bottom surface of the frame 120 is parallel to the surface of the recording medium P. When the connecting part 114 is at the 9 o'clock position, the frame 120 is rotated by the certain angle counterclockwise about the projection 104. Accordingly, the intensity of the light introduced into the light receiving part 124 cycles between the maximum and minimum values.

Figure 4:
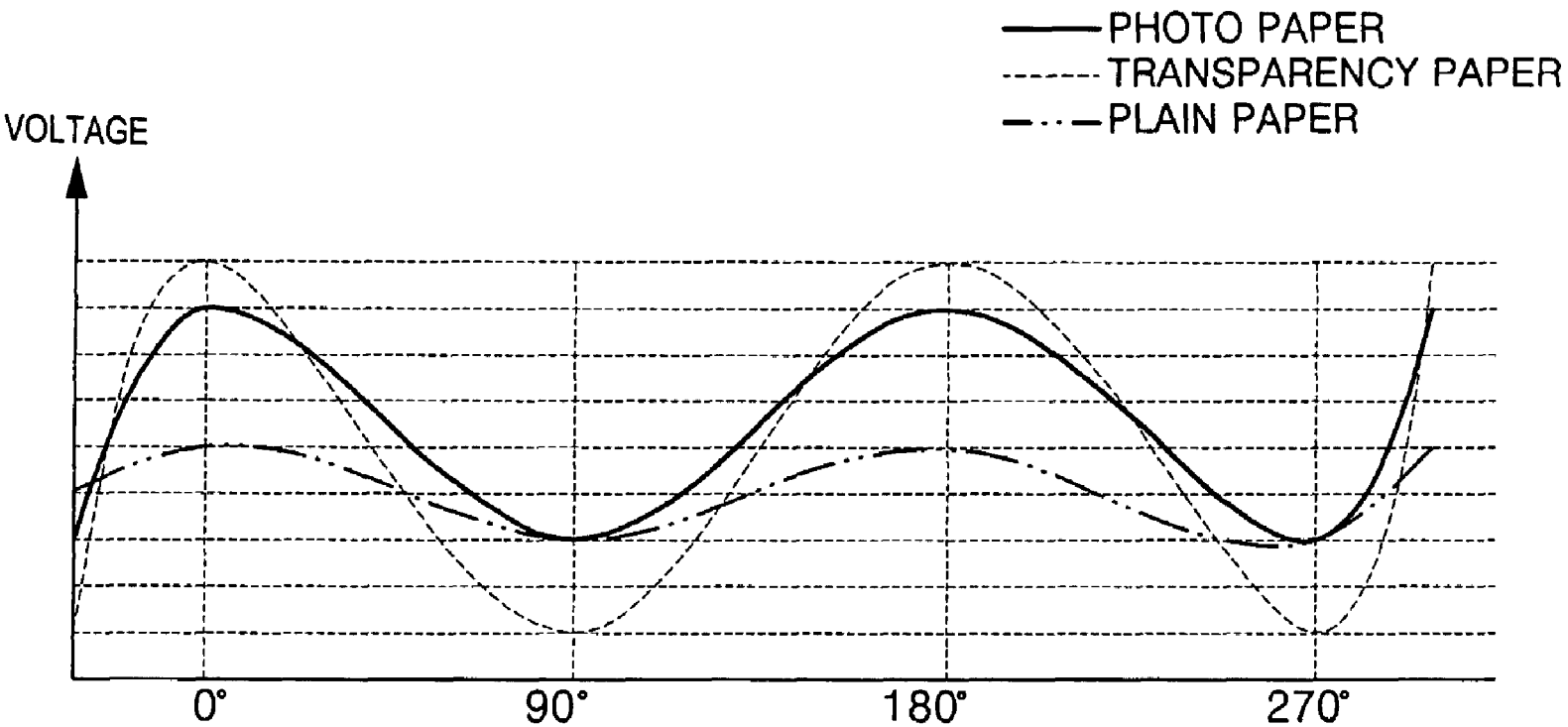
FIG. 4 is a graph illustrating ideal signal waves obtained through the media detection apparatus of FIG. 2.

FIG. 4 illustrates the intensity of the light introduced into the light receiving part 124 while the disk 110 is rotated one cycle, in an ideal case. Referring to FIG. 4, the y axis represents a magnitude of voltage output from the light receiving part 124, and the x axis represents rotational angles of the disk 110. That is, 0°, 90°, 180° and 270° of FIG. 4 correspond to FIGS. 3A, 3B, 3C and 3D, respectively. The intensity of the light is illustrated with respect to recording media of photo paper, transparency paper, and plain paper. The transparency paper has the largest difference between the maximum and minimum values, the plain paper has the smallest difference, and the photo paper has an intermediate difference. While FIG. 4 does not illustrate the intensity with respect to inkjet paper, the inkjet paper has a curve similar to the plain paper.

Figure 5:
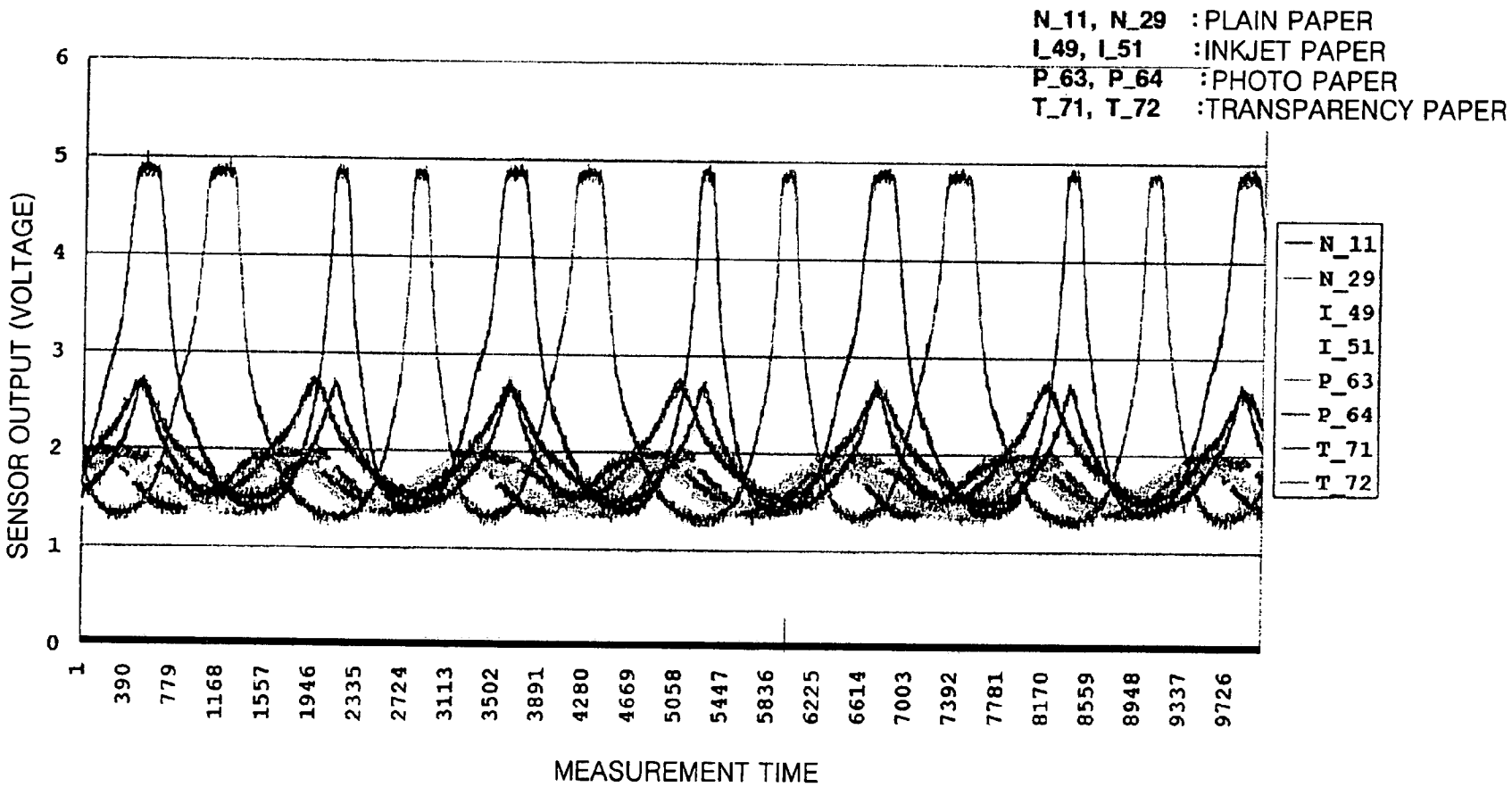
FIG. 5 is a graph illustrating real signal waves obtained through the media detection apparatus of FIG. 2.

FIG. 5 is a graph illustrating data obtained by operating the media detecting apparatus of FIG. 2 in its operation states as illustrated in FIGS. 3A-3D on two sheets of transparency paper, photo paper, inkjet paper and plain paper, respectively. Referring to FIG. 5, the y axis represents a magnitude of voltage output from the light receiving part 124, and the x axis represents a measurement time. The graph of FIG. 5 has a shape similar to the graph of FIG. 4. The ratio between the maximum and minimum values of the output of the light receiving part 124, as shown in FIG. 5, has a relationship such that the transparency paper>the photo paper>the inkjet paper≈the plain paper.

Figure 6:
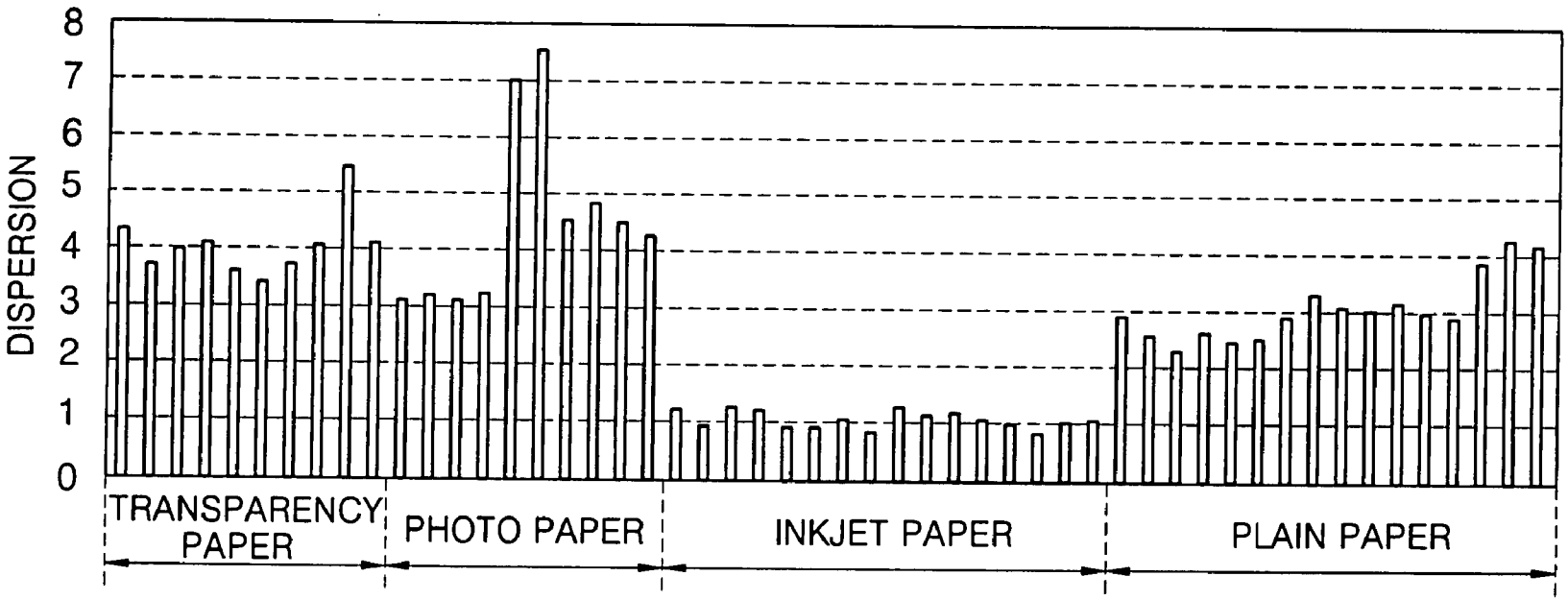
FIG. 6 is a graph illustrating dispersion values of waves obtained as recording media is moved in a lateral or longitudinal direction of the recording media in the media direction apparatus of FIG. 2.

Therefore, the transparency paper, the photo paper and the plain paper may be discriminated between by using the measured intensity values. Nevertheless, discriminating between the plain paper and the inkjet paper is impossible since the ratio of the maximum and minimum intensity values are substantially similar. FIG. 6 illustrates dispersion values for the recording media. Referring to FIG. 6, the dispersion values are taken at various points along the surface of the recording media. The inkjet paper has small variation in gloss or roughness over a surface of the recording medium, and the plain paper has a variation in gloss or roughness larger than the inkjet paper. Accordingly, the dispersion values taken at various points along the surface of the plain paper are larger than the dispersion values taken at various points along the surface of the ink jet paper, as illustrated in FIG. 6. Therefore, the plain paper and the inkjet paper may be discriminated between by using the dispersion values.

Figure 7:
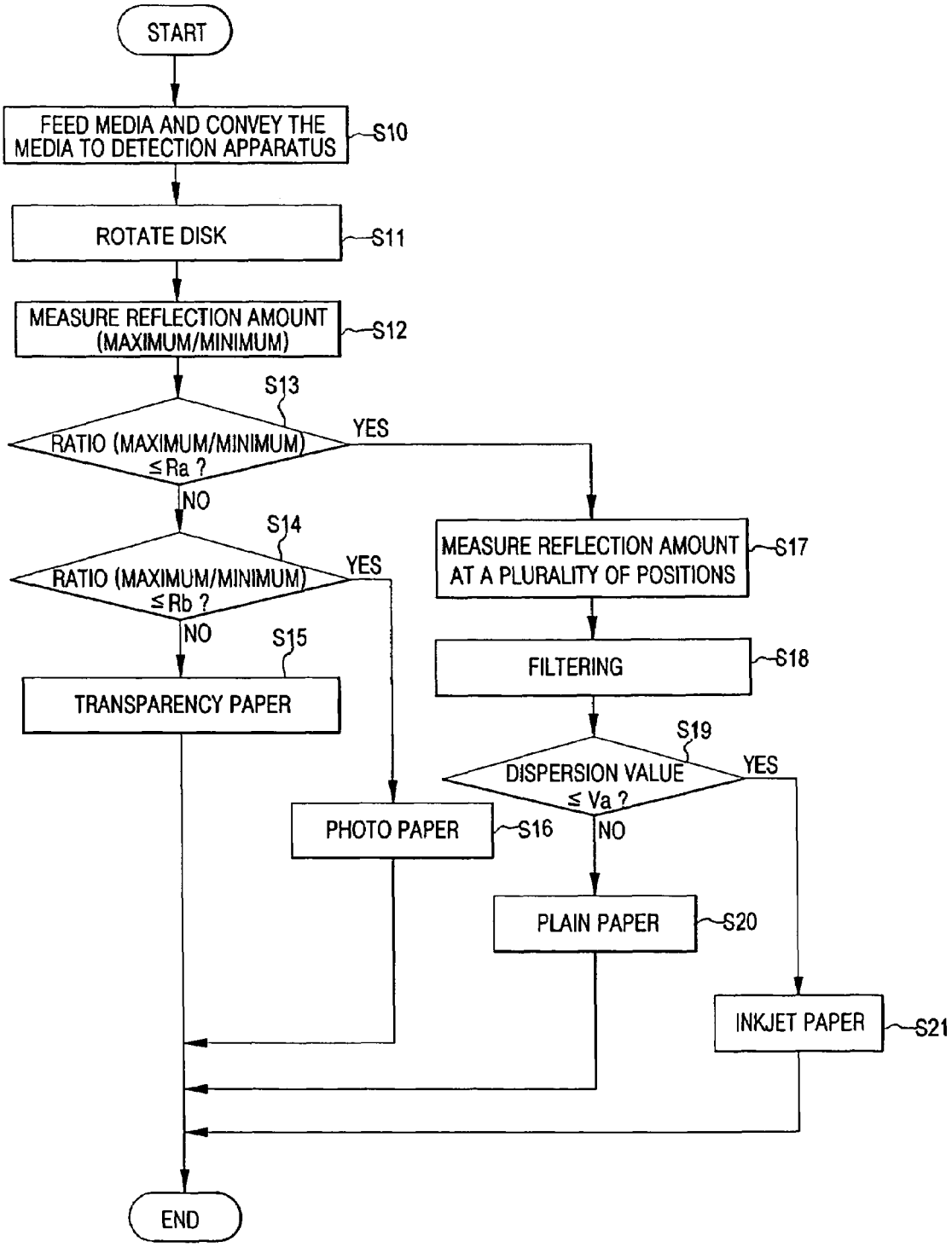
FIG. 7 is a flow chart illustrating an operation state of a controller of the media detection apparatus of FIG. 2.

FIG. 7 is a flow chart illustrating operations of the media detecting apparatus to discriminate between the plain paper and the inkjet paper. First, a recording medium P is fed into the image forming apparatus and is moved to the portion of the main body 100 where the media detection apparatus is located, at operation S10. Then, the disk 110 is rotated at operation S11 to measure the intensity of the light reflected and input to the light receiving part 124 and to calculate the ratio between the maximum and minimum values of the intensity, at operation S12. When the calculated ratio is determined to be greater than a first reference value Ra at operation S13, it is compared with a second reference value Rb at operation S14. Here, the first reference value Ra is a reference value to discriminate between the photo paper and the plain paper, and the second reference value Rb is a reference value to discriminate between the photo paper and the transparency paper. Each of the reference values Ra and Rb may be varied depending on a size of the media detection apparatus and a type of sensor mounted thereon.

When the calculated ratio between the maximum and minimum values of the intensity is determined to be greater than the second reference value Rb at operation S14, the recording medium P is determined to be the transparency paper at operation S15. When the calculated ratio is determined to be greater than the first reference value Ra at operation S13 and determined not to be greater than the second reference value Rb at operation S14, the recording medium P is determined to be the photo paper at S16.

When the calculated ratio is determined not to be greater than the first reference value Ra at operation S13, the intensity of the light is measured at a plurality of positions along the surface of the recording medium P by conveying the recording medium or moving the detection apparatus, at operation S17.

A voltage wave output by the light receiving part 124 corresponding to the measured intensity of the light is then filtered with respect to a frequency band showing waves of only the inkjet paper and the plain paper to calculate the dispersion value of the recording medium P, at operation S18. As described above, the inkjet paper has a small dispersion value since it has uniform characteristics over the surface thereof, but the plain paper has a relatively large dispersion value compared to the inkjet paper (see FIG. 6).

Accordingly, the calculated dispersion value of the recording medium P is compared with a reference dispersion value Va to discriminate between the inkjet paper and the plain paper, at operation S19. When the calculated dispersion value is determined to be greater than the reference dispersion value Va at operation S19, the recording medium P is determined to be the plain paper at operation S20. When the calculated dispersion value is determined not to be greater than the reference dispersion value at operation S19, the recording medium P is determined to be the inkjet paper at operation S21.

Figure 8:
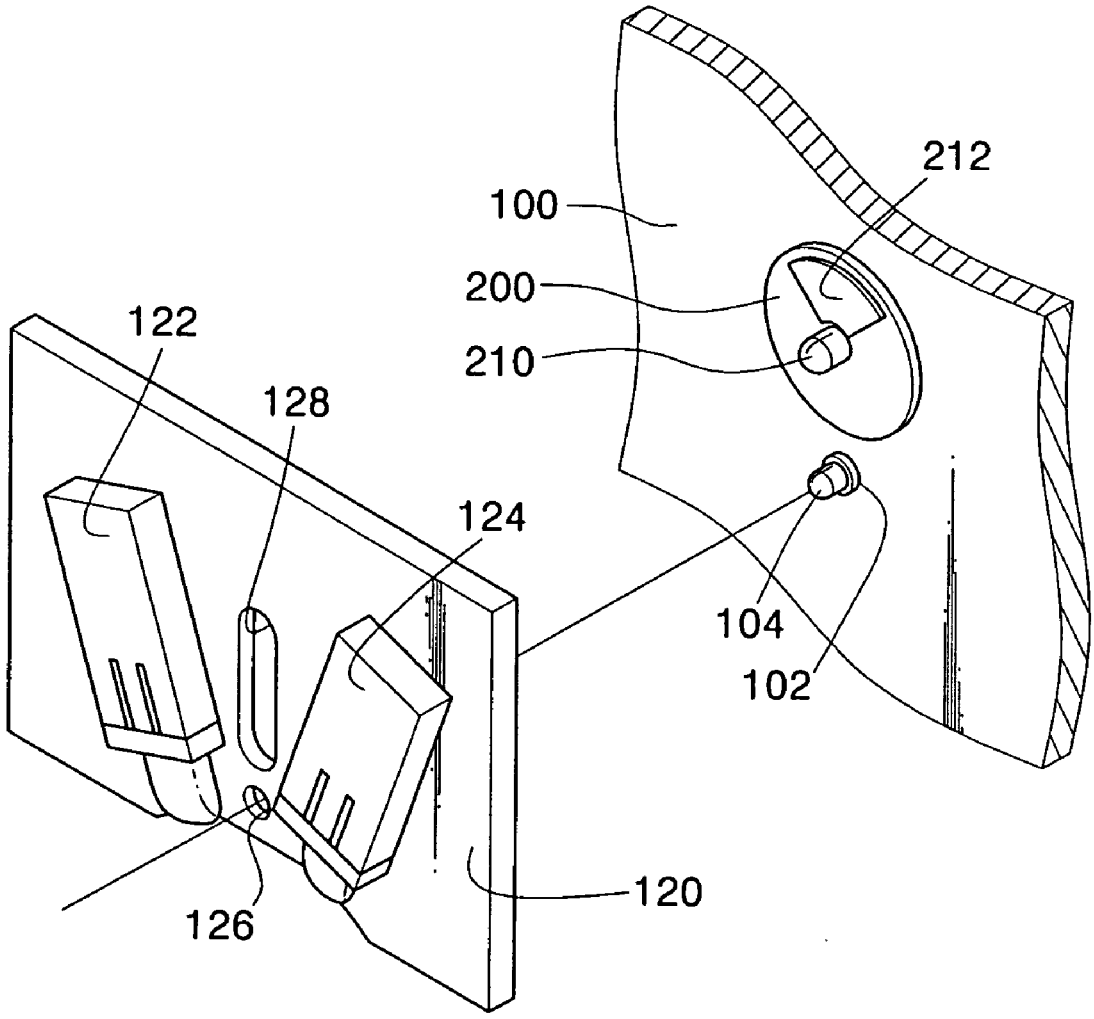
FIG. 8 is an exploded perspective view illustrating a media detection apparatus according to another embodiment of the present general inventive concept.

FIG. 8 illustrates a media detecting apparatus according to another embodiment of the present general inventive concept. The media detection apparatus of FIG. 8 is similar to the media detection apparatus of FIG. 2 except that the media detection apparatus of FIG. 8 has a driving unit (not shown) to laterally rotate the frame 120 and a slot 128' extending in a longitudinal direction through the frame 120. Therefore, hereinafter, like reference numerals designate like elements, and their descriptions will be omitted.

Referring the FIG. 8, a disk 200 rotatably engaged with a rotational shaft of the driving unit, such as a motor, is attached to a main body 100 of an image forming apparatus and a connecting part 210 is formed at a center portion of the disk 200. The connecting part 210 is inserted into the slot 128' having a radius of curvature corresponding to a distance from the projection 104 to the connecting part 210. Meanwhile, a fan-shaped eccentric weight (friction member) 212 is formed at a portion of the disk 200. When the disk 200 having the eccentric weight (friction member) 212 is rotated to generate vibration due to inertia (friction force), the frame 120 is laterally vibrated (reciprocated) with certain amplitude, as illustrated in FIGS. 9A to 9D.

Figure 9A:
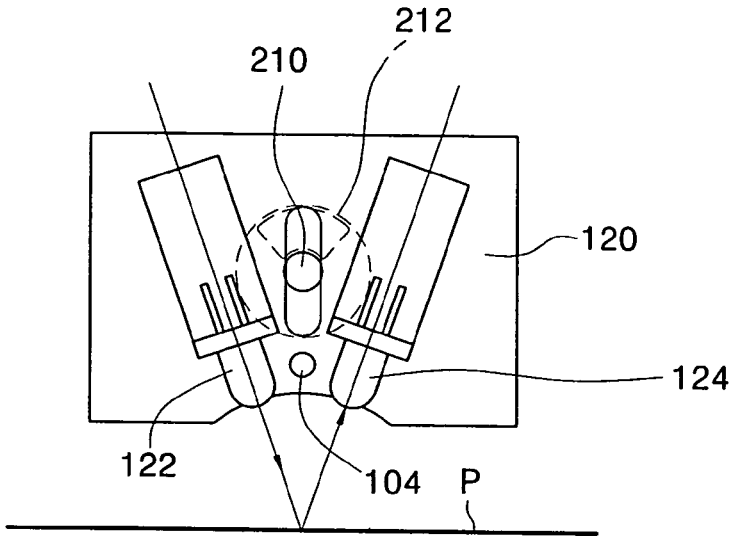
FIGS. 9A to 9D are front views illustrating an operation side of the media detection apparatus of FIG. 8.
Figure 9B:
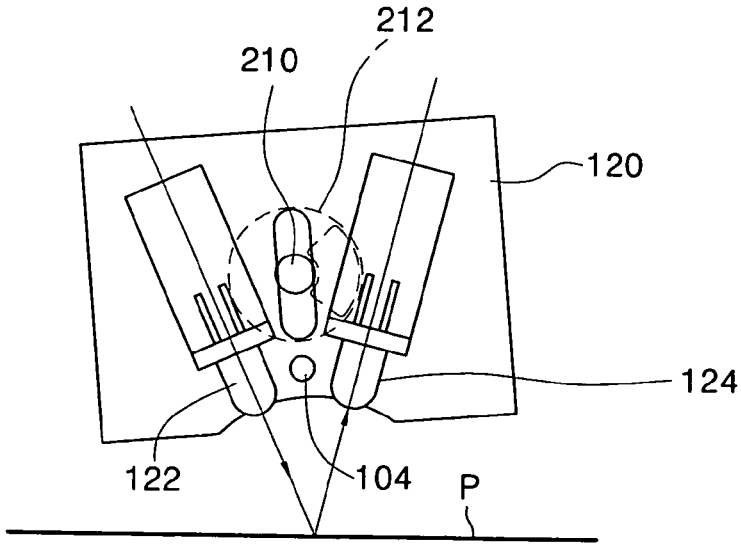
Figure 9C:
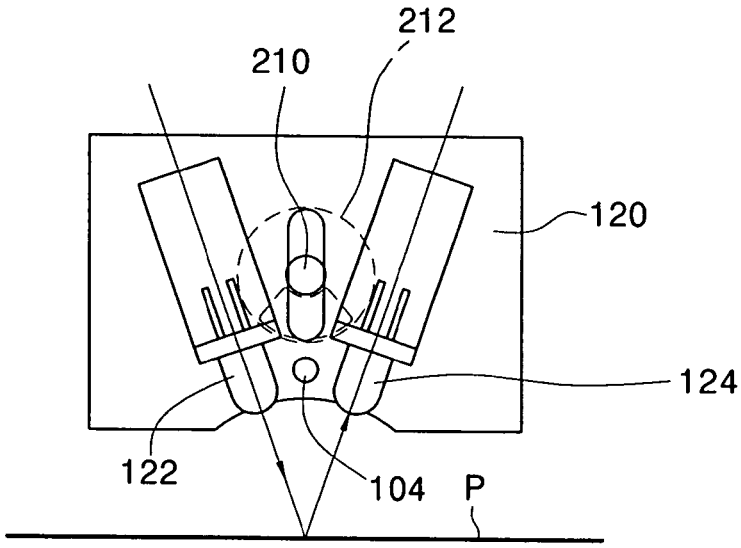
Figure 9D:
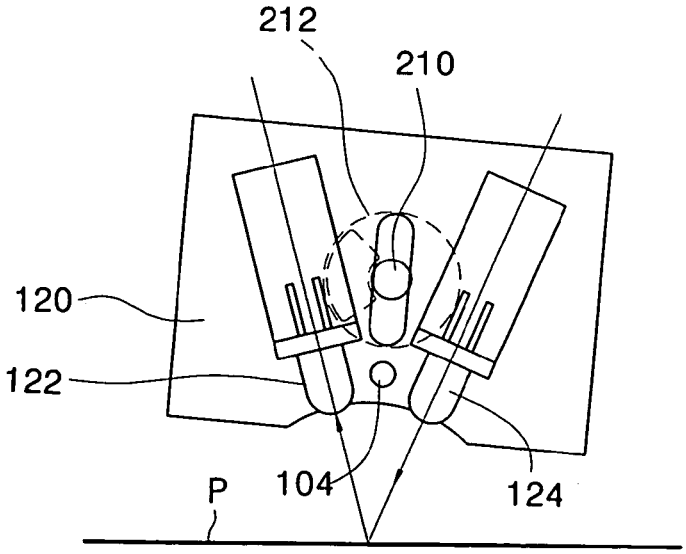

FIGS. 9A to 9D illustrate the eccentric weight (friction member) 212 at 12 o'clock, 3 o'clock, 6 o'clock, and 9 o'clock positions of the disk 200, respectively. As illustrated in FIGS. 9A and 9C, when the eccentric weight (friction member) 212 is at the 12 o'clock and 6 o'clock positions, a bottom surface of the frame 120 is parallel to a recording medium P and an intensity of the light reflected and input to the light receiving part 124 is at a maximum value. As illustrated in FIGS. 9B and 9C, when the eccentric weight (friction member) 212 is at the 3 o'clock and 9 o'clock positions, the frame 120 is vibrated by the certain amplitude in opposite directions and the intensity of the light reflected and input to the light receiving part 124 is at a minimum value.

As a result, the maximum and minimum values of the light introduced to the light receiving part 124 are used to determine a type of recording media through the same process as described above in the previous embodiment.

An image forming apparatus may then obtain optimal print results by varying print conditions depending on the determined type of recording media.

Figure 10:
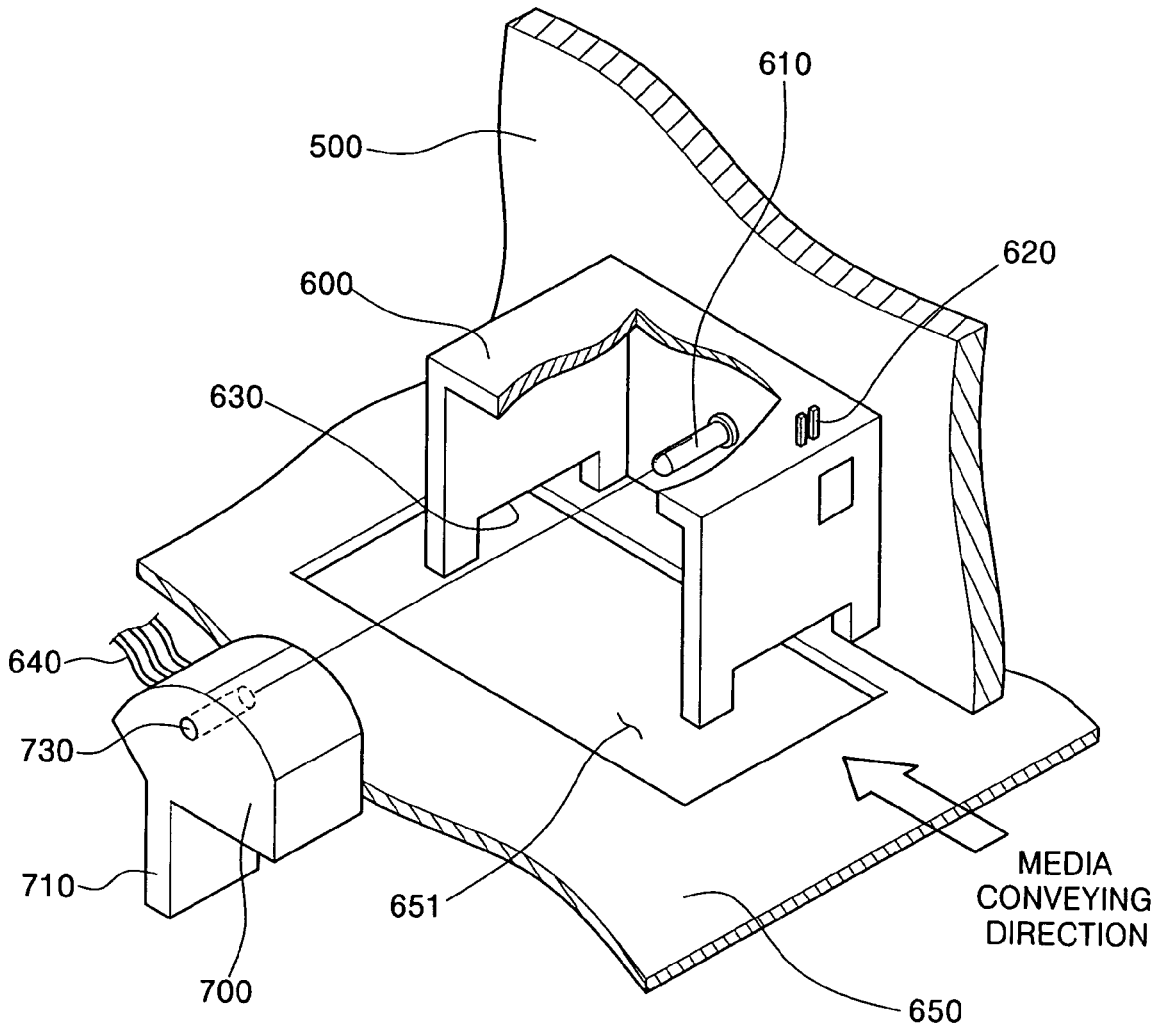
FIG. 10 is an exploded perspective view illustrating a media detection apparatus according to still another embodiment of the present general inventive concept.

FIG. 10 illustrates a media detection apparatus according to still another embodiment of the present general inventive concept. Referring to FIG. 10, the media detection apparatus connects to a portion of a main body 500 of an image forming apparatus. The media detection apparatus may be installed at arbitrary portions of the main body 500 of the image forming apparatus capable of facing a surface of a recording medium, and is therefore not limited to being positioned at any particular portion of the main body 500 of the image forming apparatus.

For example, the portion of the main body 500 at which the media detection apparatus is connected may be an arbitrary structure located on a media tray of the image forming apparatus or a conveying path of the recording medium behind a pickup roller, or may be a carriage or any portion between the pickup roller and the carriage of an inkjet printer. That is, all paper feed positions of the recording medium corresponding to any type of image forming apparatus. Hereinafter, the reference numeral 500 simply designates the image forming apparatus.

As shown in FIG. 10, a mounting case 600 having a rectangular box shape is mounted on the image forming apparatus 500. The mounting case 600 has a lower opening, and if necessary, may have a front opening. In addition, the mounting case 600 has slits 630 formed at lower end of both sides in a conveying direction of the recording medium. Further, an individual connection terminal 620 is installed at the mounting case 600, and a shaft 610 projects from an inner center portion of the mounting case 600.

A body 700 of the media detection apparatus axially engages with the shaft 610 in an eccentric manner. The body 700 has an approximate oval shape, and an axial hole 730 is formed at an upper side of the body 700 to allow the shaft 610 to pass through and to fasten thereto, thereby engaging the body 700 with the shaft 610 in the eccentric manner.

In addition, a downward projecting lever 710 is installed at a lower side of the body 700. A lower end of the lever 710 is formed at the lower side of the body 700 to pass through a hole 651 formed at a bottom plate 650 forming the conveying path of the recording medium.

Figure 11:
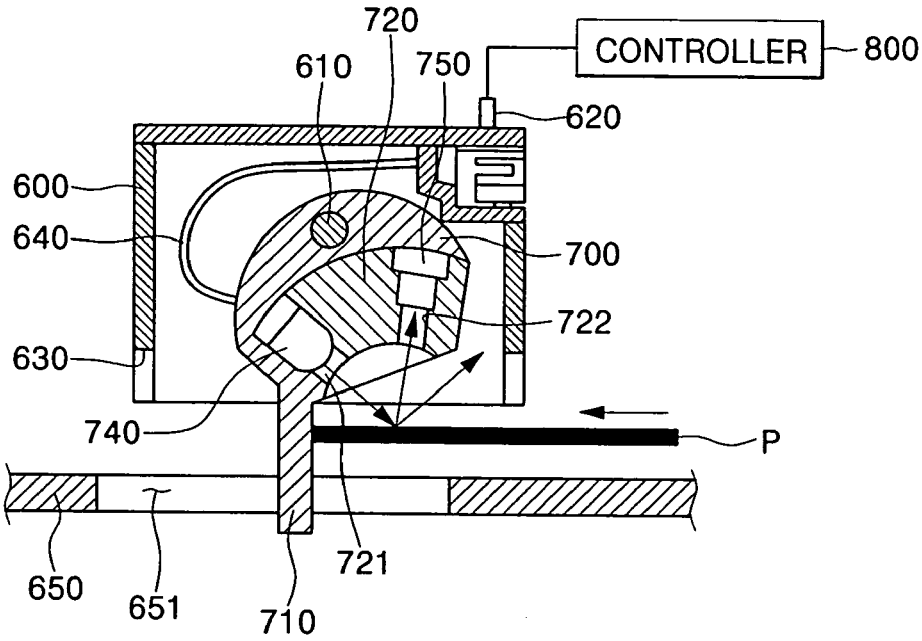
FIG. 11 is a cross-sectional view illustrating a detection operation state of a diffuse reflection region when recording media is initially entered into the media detection apparatus of FIG. 10.
Figure 12:
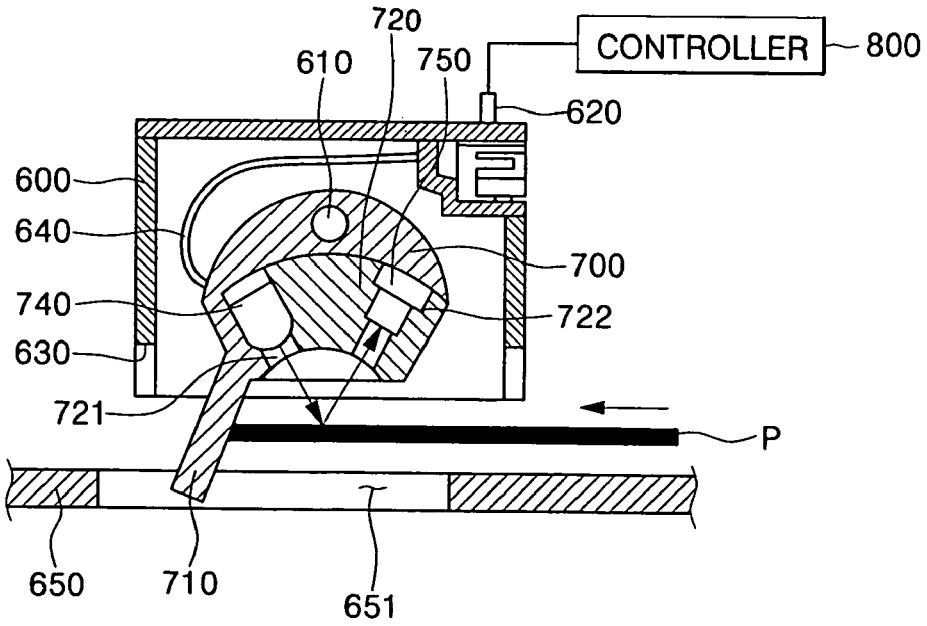
FIG. 12 is a cross-sectional view illustrating a detection operation state of a total reflection region during operation of the media detection apparatus of FIG. 10.
Figure 13:
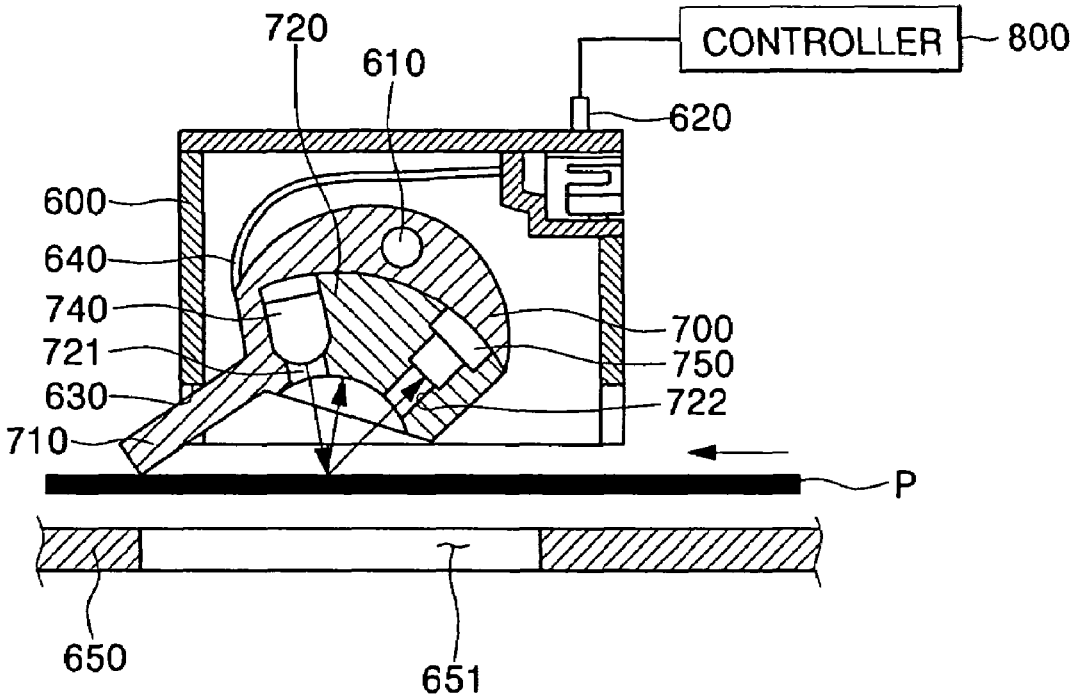
FIG. 13 is a cross-sectional view illustrating a detection operation state of a diffuse reflection region during operation of the media detection apparatus of FIG. 10.

FIGS. 11-13 illustrate operations of the media detecting apparatus of FIG. 10 when the recording medium P is conveyed through the media detecting apparatus. Although FIGS. 10-13 illustrate that the conveying direction of the recording medium P is from right to left, the conveying direction of the recording medium P may be reversed in direction depending on a structure of the image forming apparatus 500. Accordingly, a position of the lever 710 may also be changed. In addition, the hole 651 of the bottom plate 650 has a size sufficient to enable rotation of the lever 710 in a lateral direction.

Referring to FIGS. 10-13, a light source 740 and a light receiving part 750 are installed in the body 700. The light source 740 can employ a light emitting diode. However, the light source 740 is not limited to the light emitting diode, and can alternatively employ a laser diode or other light sources. The light source 740 is installed to irradiate light at a lower part of the body 700 in an inclined manner, and the light receiving part 750 is also located toward the lower part of the body 700 in an inclined manner toward a light receiving direction of reflected light from the light source 740.

The light receiving part 750 is made of a single light receiving device. The light receving device may employ a photo diode, a photo transistor, an avalanche photo diode, a charge coupled device (CCD), a CMOS image sensor (CIS) or other types of devices.

The light source 740 and the light receiving part 750 are installed to form an acute angle with respect to a path of light, and installed symmetrically with respect to each other. In addition, the light source 740 and the light receiving part 750 are installed to have the same focus length and maintain the same focus direction in spite of rotation of the light source 740 and the light receiving part 750. A scan distance of the light source 740 and a light receiving distance of the light receiving part 750 are always equally maintained in spite of the rotation. "Equally maintained" means that the distances are within an error range.

A guide member 720 to guide light emitted from the light source 740 to the recording medium P and to guide light reflected from the recording medium P to the light receiving part 750 is installed at a lower portion of the body 700, at which the light source 740 and the light receiving part 750 are installed. The guide member 720 serves to improve irradiation and reception efficiency of the light source 740 and the light receiving part 750, and also to increase measurement precision.

The guide member 720 includes a first guide passage 721 to guide the light irradiated from the light source 740 and a second guide passage 722 to guide the light reflected from the recording medium P to the light receiving part 750. The first guiding passage 721 extends in an irradiation direction of the light, and the second guide passage 722 extends in a reception direction of the light.

Accordingly, the light emitting direction and the light receiving direction can be stably maintained. Separate optical fibers may be filled in the first and second guide passages 721 and 722 to be used therein.

A flexible circuit board 640 to apply a resilient force to the body 700 in a direction reverse to the conveying direction of the recording medium P is disposed in the mounting case 600 in a bent state. The flexible circuit board 640 applies operating power to the light source 740 and the light receiving part 750, and simultaneously transmits an output value detected through the light receiving part 750 to a controller 800. Alternatively, in addition to the flexible circuit board 640, a separate resilient member may be installed to apply a resilient force to the body 700 in the direction reverse to the conveying direction of the recording medium P.

The flexible circuit board 640 is connected to the individual connection terminal 620 located at an upper portion of the mounting case 600, and the connection terminal 620 is connected to the controller 800. The controller 800 may be adapted together with a controller of the image forming apparatus 500, or may be provided as a separate component. The controller 800 compares the ratio of maximum and minimum values of the output values measured through the light receiving part 750 with a predetermined value to detect a type of the recording medium P.

Figure 16:
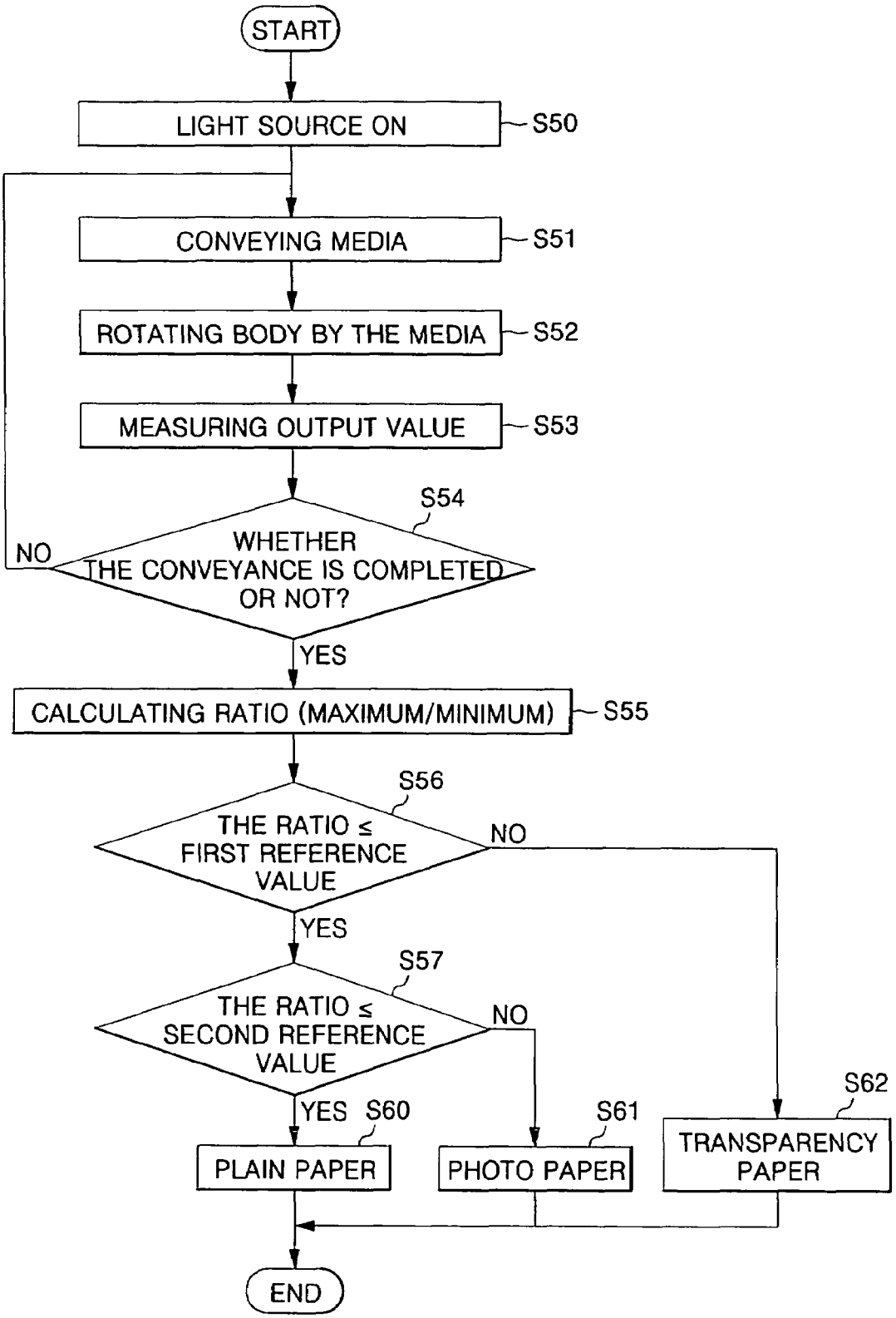
FIG. 16 is a flow chart representing operations of the media detection apparatus of FIG. 10.

FIG. 16 illustrates operations of the media detection apparatus of FIG. 10.

Referring to FIGS. 10-13 and 16, light is irradiated from the light source 740 onto a conveying path in which the recording medium P passes. At this time, the irradiation of light is performed by emitting light from the light source 740 as power is applied to the light source 740 (operation S50).

Then, the recording medium P is conveyed along the conveying path into a light irradiation region of the light source 740 (operation S51). The conveyance of the recording medium P can be performed by using a pickup roller (not shown) to transfer the recording medium P, into a lower portion of the mounting case 600. When the recording medium P is conveyed into the light irradiation region, the recording medium P contacts the lever 710 and causes the body 700 to rotate (operation S52). As the body 700 rotates, the light is reflected from the recording medium P, and the reflected light is received by the light receiving part 750. Then, an output value of the received light reflected from the recording medium P is measured (operation S53).

As illustrated in FIG. 11, when the recording medium P initially contacts the lever 710, the lever 710 is vertically disposed with respect to the recording medium P. Therefore, the body 700 is located at a diffuse reflection angle, at which an irradiation angle of the light source 740 and a reception angle of the light receiving part 750 are different from each other.

Therefore, while the light is irradiated from the light source 740 through the first guide passage 721 to be reflected from the recording medium P at the diffuse reflection angle and a total reflection angle respectively, since the light receiving part 750 is located at the diffuse reflection angle, the light receiving part 750 detects the diffuse reflected light only. When the diffuse reflected light is detected in the light receiving part 750, the controller 800 obtains a minimum output value.

Next, when the recording medium P continuously moves, the angle of the light is varied. As illustrated in FIG. 12, varying the angle of the light is performed as the recording medium P pushes the lever 710 and rotates the lever 710 and the body 700 in the conveyance direction of the recording medium P. While the body 700 is continuously rotated, when the light irradiation angle of the light source 740 and the light receiving angle of the light receiving part 750 are the same with respect to the recording medium, the controller 800 can obtain an output value of the total reflection greater than that of the diffuse reflection.

Next, when the recording medium P is conveyed further and the lever 710 is also rotated further as a result, as shown in FIG. 13, the body 700 is again rotated to a position of mostly diffuse reflection, at which the light irradiation angle and the light reflection angle become different with respect to the recording medium. The diffuse reflection state is maintained until the recording medium P is conveyed externally from the media detection apparatus. In this state, the controller 800 obtains an output value less than that in the total reflection state.

Next, whether the conveyance of the recording medium P is completed is determined (operation S54). As a result of the determination, when the media P is not completely conveyed, the aforementioned operations S51-S53 are repeated, and when the conveyance is completed, the type of recording medium P is determined as described below.

Figure 14:
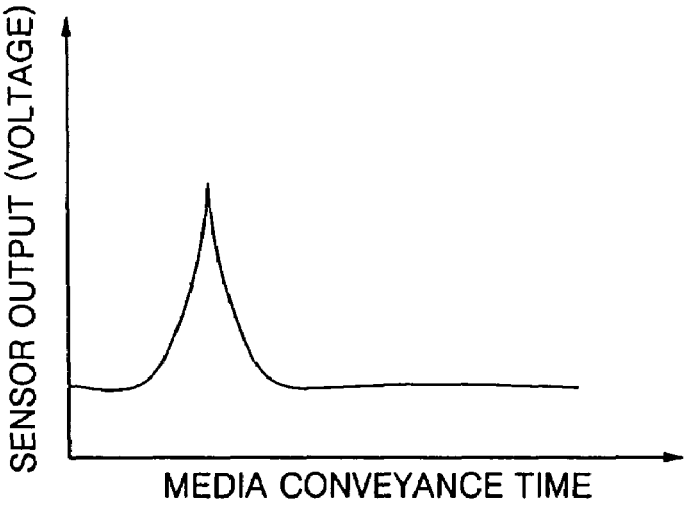
FIG. 14 is a view illustrating continuously detected measurement values of FIGS. 11, 12 and 13.

Meanwhile, when the output values are continuously detected, the graph illustrated in FIG. 14 is obtained. That is, at a time when the total reflection is generated as the body 700 is rotated, an output peak point at which the sensor output is at a maximum is obtained.

Figure 15:
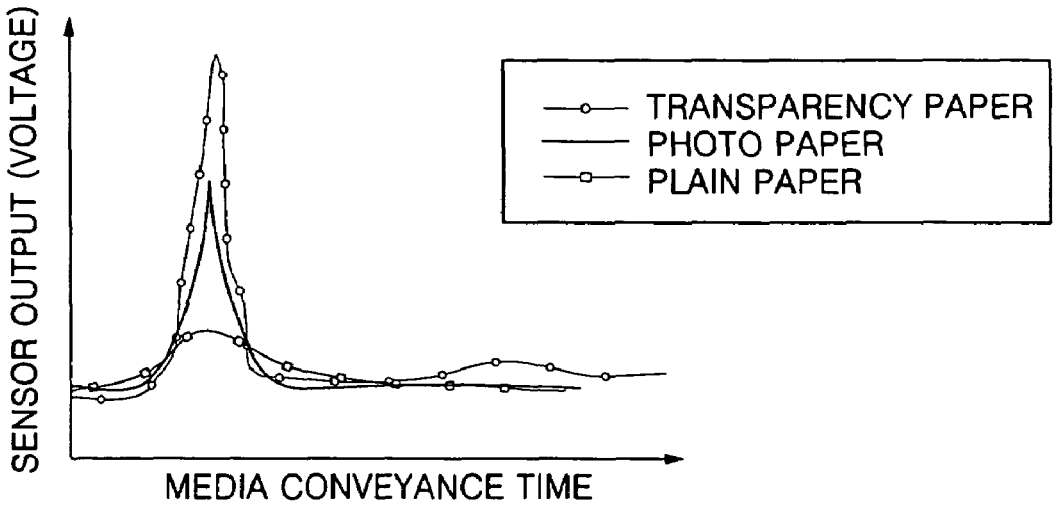
FIG. 15 is a view illustrating continuously detected measurement values depending on a type of recording media using the media detection apparatus of FIG. 10.

The sensor output has different values depending on the type of recording medium P. The difference between sensor output values of different types of recording media P is minor in the case of the diffuse reflection, but in the case of the total reflection, the difference is remarkably increased. For example, as illustrated in FIG. 15, in the case of typical recording media P, such as transparency paper, photo paper and plain paper, when the light source 740 and the light receiving part 750 are employed at the same angle with respect to the recording media, the transparency paper has the greatest total reflection output peak, the photo paper has a total reflection output peak less than that of the transparency paper, and the plain paper has an output peak less than that of the photo paper. Based on the sensor output date, the controller 800 performs the determination of the type of recording medium P.

The controller 800 calculates the ratio of the maximum value measured in the light receiving part 750 and the minimum value measured in the light receiving part 750 (operation S55). At this time, as the ratio increases, the glossiness of the recording medium P increases, and as the ratio decreases, the glossiness decreases. For example, as illustrated in FIG. 15, the transparency paper has the greatest ratio, the photo paper has a ratio less than that of the transparency paper, and the plain paper has a ratio less than that of the photo paper. As a result, the type of recording medium P can be detected using the differences between the ratios.

Therefore, the controller 800 compares the ratio difference with predetermined values set in the controller 800 to determine the type of recording medium P. The predetermined values include a first predetermined value set as a ratio of the maximum and minimum values of the transparency paper, a second predetermined value set as a ratio of the maximum and minimum values of the photo paper, and a third predetermined value set as a ratio of the maximum and minimum values of the plain paper. Then, a first reference value between the first and second predetermined values is obtained and a second reference value between the second and third predetermined values is also obtained. The reference values can be stored in the controller 800 together with the predetermined values.

In this process, for example, when the first predetermined value is "3" and the second predetermined value is "2", the first reference value may be approximately "2.5", and when the third predetermined value is "1", the second reference value may be approximately "1.5". Constant values of the predetermined values and the reference values may be obtained from comparative data based on actual data obtained through previous tests.

The controller 800 then compares the calculated ratio with the first reference value (operation S56). When the calculated ratio is greater than the first reference value, the controller determines the recording medium P to be the transparency paper (operation S62). However, when the calculated ratio is not greater than the first reference value, the controller 800 compares the calculated ratio with the second reference value (operation S57).

When the calculated ratio is greater than the second reference value, the controller determines the recording medium P to be the photo paper (operation S61). However, when the calculated ratio is not greater than the second reference value, the controller determines the recording medium P to be the plain paper (operation S60).

Therefore, utilizing the measurement values, it is possible to readily discriminate between the transparency paper, the photo paper, and the plain paper. However, it is difficult to precisely discriminate between the plain paper and inkjet paper in consideration of an error. The inkjet paper has uniform deviation of glossiness, roughness and so on over a surface thereof, and the plain paper has large deviation in comparison with the inkjet paper. Therefore, it is possible to discriminate between the plain paper and the inkjet paper when a plurality of media detection apparatuses are installed on the conveyance path of the recording medium P.

When the detection of the recording medium P is completed, the image forming apparatus controls driving and print conditions to print images depending on the type of the recording medium P. In addition, it is possible to improve print precision and image quality when various print conditions are set appropriately to each type of recording media depending on a type and structure of the image forming apparatus 500.

As described above, the present general inventive concept is capable of reducing a number of parts since one light receiving part and one light source are used, and stably printing various recording media since it is possible to precisely detect the type of recording media even when surfaces of the recording media are irregular. In addition, the present general inventive concept provides an effect capable of maintaining uniform detection probability since an irradiation angle of the light source is continuously varied, even when the main body and the frame of the image forming apparatus are deformed due to long-term use.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. A media detection apparatus comprising:

a light source to irradiate light to surfaces of recording media;

a light receiving part to receive light reflected from the recording media; and a controller to determine a type of the recording media through signals measured by the light receiving part while at least one of angles of the light source and the light receiving part are varied with respect to the recording media.

2. The media detection apparatus according to claim 1, wherein the angles of the light source and the light receiving part with respect to the recording media are simultaneously varied.

3. The media detection apparatus according to claim 1, wherein the angles of the light source and the light receiving part with respect to the recording media are continuously varied within a predetermined range.

4. The media detection apparatus according to claim 1, further comprising:

a frame to fix at least one of the light source and the light receiving part;

a link installed at the frame to allow the frame to reciprocate asymmetrically with respect to the surfaces of the recording media; and a driving mechanism to drive the link.

5. The media detection apparatus according to claim 4, wherein the link comprises:

a slot formed in the frame;

a circular plate rotatable by the driving mechanism; and a projection formed at one side of the circular plate and inserted into the slot.

6. The media detection apparatus according to claim 1, further comprising:

a frame to fix at least one of the light source and the light receiving part;

an eccentric weight connected to the frame; and a driving mechanism to rotate the eccentric weight.

7. The media detection apparatus according to claim 1, wherein the controller detects the type of the recording media by comparing a ratio between maximum and minimum values of the signals measured by the light receiving part with one or more predetermined values.

8. The media detection apparatus according to claim 7, wherein the controller determines the recording media to be transparency paper when the ratio between the maximum and minimum values is greater than a predetermined second reference value, determines the recording media to be photo paper when the ratio between the maximum and minimum values is not greater than the second reference value and greater than a predetermined first reference value having a value less than the second reference value, and when the ratio between the maximum and minimum values is not greater than the first reference value, calculates a dispersion value after measuring the signals at a plurality of portions of the recording media, determines the recording media to be plain paper when the calculated dispersion value is greater than a predetermined dispersion value, and determines the media to be inkjet paper when the calculated dispersion value is not greater than the predetermined dispersion value.

9. The media detection apparatus according to claim 8, wherein the dispersion value is measured at a plurality of portions along a lateral or longitudinal direction of the recording media.

10. The media detection apparatus according to claim 9, wherein the dispersion value is calculated based on data obtained by filtering the signals measured by the light receiving part.

11. A media detection method of an image forming apparatus, comprising:

obtaining signals by reciprocating a media detection apparatus having a light source to irradiate light to surfaces of recording media and a light receiving part to receive light reflected from the recording media within a predetermined range;

calculating a ratio between maximum and minimum values of the obtained signals; and determining a type of recording media by comparing the calculated ratio with one or more predetermined values.

12. The media detection method according to claim 11, wherein, the determining the type of recording media by comparing the calculated ratio with one or more the predetermined values comprises:

determining the recording media to be transparency paper when the calculated ratio between the maximum and minimum values is greater than a predetermined second reference value;

determining the recording media to be photo paper when the calculated ratio is not greater than the second reference value and greater than a predetermined first reference value having a value less than the second reference value; and when the ratio between the maximum and minimum values is not greater than the first reference value, calculating a dispersion value after measuring the signals at a plurality of portions of the recording media, determining the recording media to be plain paper when the calculated dispersion value is greater than a predetermined dispersion value, and determining the recording media to be inkjet paper when the calculated dispersion value is not greater than the predetermined dispersion value.

13. The media detection method according to claim 12, wherein the calculating a dispersion value comprises:

measuring the dispersion value of the recording media at a plurality of portions along a lateral or longitudinal direction of the media.

14. The media detection method according to claim 12, wherein the calculating a dispersion value comprises:

calculating the dispersion value based on data obtained by filtering the obtained signals.

15. A media detection apparatus comprising:

a light source to irradiate light to surfaces of recording media;

a light receiving part to receive light reflected from the recording media;

an angle changing unit to change an angle of at least one of the light source and the light receiving part with respect to the recording media as the recording media is transferred, the angle changing unit having:

a body eccentrically installed at a conveying path of the recording media and installed in an inclined manner to allow the light source and the light receiving part to face the recording media; and a lever extending on to the conveying path of the recording media from the body to rotate the body in a conveying direction of the recording media by a force of the recording media; and a controller to determine a type of the recording media through signals measured from the light receiving part depending on the angle changed by the angle changing unit.

16. The media detection apparatus according to claim 15, further comprising;

a mounting case to axially support the body therein installed at the conveying path of the recording media; and a flexible circuit board disposed at the mounting case to apply a resilient force to the body in a direction opposite to the conveying direction of the recording media.

17. The media detection apparatus according to claim 15, wherein the body comprises:

a first guide passage to guide the light irradiated from the light source to the recording media; and a second guide passage to guide the light reflected from the recording media to the light receiving part.

18. The media detection apparatus according to claim 15, wherein the controller compares a ratio of maximum and minimum values of the signals measured from the light receiving part with a predetermined value to determine the type of the recording media.

19. The media detection apparatus according to claim 15, wherein the light receiving part comprises one light receiving device.

20. The media detection apparatus according to claim 15, wherein the light source and the light receiving part are fixed to be directed to the same focus.

21. The media detection apparatus according to claim 15, wherein the light receiving part alternately detects diffuse reflection and total reflection of the light reflected from the recording media using the angle changing unit.

22. A method of detecting a type of recording media, comprising:

irradiating light from a light source;

conveying the recording media to a light irradiation region of the light source;

changing an angle of light reflected from the recording media by the conveyance of the media where a body eccentrically installed at a conveying path of the recording media and installed in an inclined manner allows the light source and the light receiving part to face the recording media and a lever extending onto the conveying path of the recording media from the body rotates the body in a conveying direction of the recording media by a force of the recording media;

detecting light in a light receiving part to obtain measurement values by changing the angle;

calculating a ratio of maximum and minimum values of the measurement values in a controller; and comparing the calculated ratio with predetermined values stored in the controller to detect a type of recording media.

23. The method according to claim 22, wherein the predetermined values include a first predetermined value set as a ratio corresponding to transparency paper, a second predetermined value set as a ratio corresponding to photo paper, and a third predetermined value set as a ratio corresponding to plain paper.

24. The method according to claim 23, wherein the comparing the calculated ratio with the predetermined values stored in the controller to detect the type of recording media comprises:

recognizing the recording media as the transparency paper when the ratio is greater than a first reference value between the first and second predetermined values;

recognizing the recording media as the photo paper when the ratio is equal to or less than the first reference value and greater than a second reference value between the second and third predetermined values; and recognizing the recording media as the plain paper when the ratio is equal to or smaller than the second reference value.

25. A recording medium detection apparatus, comprising:

a light emitting and receiving unit to irradiate light to a surface of a recording medium, to receive light reflected from the surface of the recording medium, and to measure an intensity of the received light, the light emitting and receiving unit being variably positionable with respect to the surface of the recording medium to measure the intensity at a plurality of angles with respect to the surface of the recording medium; and a controller to control the variable positioning of the light emitting and receiving unit, and to determine a type of the recording medium by a comparison of one or more predetermined values with a calculated ratio between maximum and minimum values of the obtained signals from the light receiving unit.

26. The recording medium detection apparatus according to claim 25, wherein the controller comprises a rotating unit to rotate the light emitting and receiving unit with respect to the surface of the recording medium.

27. The recording medium detection apparatus according to claim 26, wherein the rotating unit comprises:

a frame to support the light emitting and receiving unit; and a disk connected to the frame to rotate the frame within a predetermined angle range with respect to the recording medium.

28. The recording medium detection apparatus according to claim 27, wherein when the disk rotates the frame through the predetermined angle range, the light emitting and receiving unit measures at least one maximum intensity and at least one minimum intensity of the received light.

29. The recording medium detection apparatus according to claim 25, further comprising:

a housing surrounding the light emitting and receiving unit; and a lever connected to the housing to contact the recording medium and rotate the housing according to movement of the recording medium.

30. The recording medium detection apparatus according to claim 25, wherein the controller determines a type of the recording medium according to the measured intensity at the plurality of angles.

31. A recording medium detection apparatus, comprising:

a light source to irradiate light onto a surface of a recording medium; and a light receiving part rotatable with respect to the surface of the recording medium to receive light reflected from the surface of the recording medium at a total reflection angle and a diffuse reflection angle, wherein a type of recording medium is determined according to a ratio of intensity of the reflected light at the total reflection angle and intensity of the reflected light at the diffuse reflection angle while at least one of angles of the light source and the light receiving part are varied with respect to the recording medium.

32. The recording medium detection apparatus according to claim 31, wherein the light source rotates with the light receiving part with respect to the surface of the recording medium.

33. The recording medium detection apparatus according to claim 31, wherein the light receiving part measures the intensity of the reflected light at each of the total reflection angle and the diffuse reflection angle.

34. The recording medium detection apparatus according to claim 33, wherein the light receiving part comprises:

a controller to determine the ratio of the intensity of the reflected light at the total reflection angle and the intensity of the reflected light at the diffuse reflection angle.

35. An image forming apparatus, comprising:

a conveyance path to convey a recording medium; and a recording medium detection unit disposed at the conveyance path to determine a type of the recording medium by a comparison of one or more predetermined values with a calculated ratio between maximum and minimum values of the obtained signals from a light receiving part, the media detection unit comprising;

a light source to irradiate light onto the recording medium, and the light receiving part to receive light reflected from the recording medium, the light source and the light receiving part fixed at a predetermined angle with respect to each other and movably installed at the conveyance path to irradiate and receive light to and from the recording medium at a plurality of angles.

36. A method of determining a type of recording medium, the method comprising:

rotating a light source and a light receiving part to measure intensity of light reflected from a recording medium at a plurality of angles; and determining a type of recording medium according to the measured intensity at the plurality of angles by a comparing of one or more predetermined values with a calculated ratio between maximum and minimum values of the measured intensity of light.

37. The method according to claim 36, wherein the rotating the light source and the light receiving part comprises:

rotating the light source and the light receiving part to measure the intensity of the light reflected from the recording medium at a total reflection angle and a diffuse reflection angle.

38. The method according to claim 37, wherein the determining the type of recording medium comprises:

comparing a ratio of the intensity of the light measured at the total reflection angle to the intensity of the light measured at the diffuse reflection angle to one or more predetermined values.

39. The method according to claim 36, wherein the determining the type of recording medium comprises:

determining the type of recording medium according to a ratio of a maximum measured intensity to a minimum measured intensity.

* * * * *